US007520232B2

(12) United States Patent
Miyazaki et al.

(10) Patent No.: US 7,520,232 B2
(45) Date of Patent: Apr. 21, 2009

(54) TANK COVERS AND SHIPS

(75) Inventors: Satoshi Miyazaki, Nagasaki-ken (JP); Hiroshi Shirakihara, Nagasaki-ken (JP); Koichi Sato, Nagasaki-ken (JP); Manabu Ichinose, Nagasaki-ken (JP)

(73) Assignee: Mitsubishi Heavy Industries, Ltd., Tokyo (JP)

( * ) Notice: Subject to any disclaimer, the term of this patent is extended or adjusted under 35 U.S.C. 154(b) by 0 days.

(21) Appl. No.: 10/935,158

(22) Filed: Sep. 8, 2004

(65) Prior Publication Data

US 2005/0061222 A1 Mar. 24, 2005

(30) Foreign Application Priority Data

Sep. 24, 2003 (JP) ..... 2003-331478

(51) Int. Cl.
*B63B 25/08* (2006.01)

(52) U.S. Cl. ..... 114/74 A

(58) Field of Classification Search ..... 114/74 A, 114/74 T, 201 R, 74 R; 220/560.04–560.14, 220/901; 52/81.4
See application file for complete search history.

(56) References Cited

U.S. PATENT DOCUMENTS 2,386,958 A * 10/1945 Jackson ..... 62/45.1
RE26,165 E * 2/1967 Stolz ..... 52/81.4
3,903,824 A * 9/1975 Laverman et al. ..... 114/74 A
4,106,423 A * 8/1978 Glasfeld et al. ..... 114/74 A

FOREIGN PATENT DOCUMENTS

| | | |
|---|---|---|
| JP | 63-38800 | 2/1988 |
| JP | 63-159193 | 7/1988 |
| JP | 1-164696 | 6/1989 |
| JP | 2-85600 | 3/1990 |
| JP | 2-217698 | 8/1990 |
| JP | 3-35893 | 4/1991 |
| JP | 5-22289 | 3/1993 |

OTHER PUBLICATIONS

Cargo Tank Cover Drawing for ship No. 1469-1472, dated Dec. 3, 2002.

* cited by examiner

*Primary Examiner*—Ed Swinehart
(74) *Attorney, Agent, or Firm*—Wenderoth, Lind & Ponack, L.L.P.

(57) ABSTRACT

The fatigue strength of a bottom end part jointed to an upper deck of a hull is sufficiently maintained to thereby improve fatigue life. In a tank cover which covers a protruding part of an independent spherical tank loaded in a ship with one part protruding above an upper deck of a hull, a bottom end part to be jointed to the upper deck is provided with a reinforced part which is reinforced for strength. The reinforced part is a thickened part with a thickness greater than a thickness of an other part. The reinforced part is provided on both ends in a direction along the width direction of the hull.

8 Claims, 9 Drawing Sheets

TANK COVERS AND SHIPS

BACKGROUND OF THE INVENTION

1. Field of the Invention

The present invention relates to a tank cover which covers an independent spherical tank loaded for example in a ship, such as a liquefied natural gas carrier (LNG carrier).

This application is based on Japanese Patent Application No. 2003-331478, the content of which is incorporated herein by reference.

2. Description of Related Art

In a ship such as an LNG carrier, as shown in FIG. 5, for example, independent spherical tanks 15 which accommodate liquefied natural gas are loaded so that a plurality of them are arranged along the longitudinal direction of a hull 10 (left and right direction in FIG. 5), partially protruding above an upper deck 11 of the hull 10.

In such a ship, the protruding part of the each of the independent spherical tanks 15 which protrudes above the upper deck 11 is covered by a tank cover 20 for protecting the independent spherical tank 15 from outside air or sea water. The tank cover 20 is a hollow body comprising an approximate hemispherical part 21 and an approximate cylindrical part 22. A bottom end part 23 of the approximate cylindrical part 22 (bottom end part 23 of the tank cover 20) is jointed to the upper deck 11 of the hull 10 by welding.

If a vertical bending moment occurs in the hull 10 due to the load received when the ship is navigating in waves, then as shown in the side view of FIG. 6A, the tank cover 20 having the bottom end part 23 welded to the upper deck 11 of the hull 10 deforms in the opposite direction to the deformation of the hull 10, and therefore a large load is caused in the bottom end part 23 of this tank cover 20 due to compression and tension. At the same time, the approximate cylindrical part 22 receives a deformation by a tensile force in the longitudinal direction of the hull and a deformation by a compressive force in the beam direction (refer to the plan view of FIG. 6B). Particularly, in the bottom end part 23 of the tank cover 20, the load and the forced deformation occurring in the front and back ends (both end parts in the direction along the longitudinal direction of the hull 10, part A in FIG. 5), and the left and right ends (both end parts in the direction along the width direction of the hull 10, part B in FIG. 5) become very large.

For example, when the load compressing toward the upper deck 11 of the hull 10 and the deformation by a compressive force toward the inside (right side in FIG. 7) occur in the bottom end part 23 of the tank cover 20, then as shown in FIG. 7, the bottom end part 23 of the tank cover 20 deforms so as to bend toward the inside of the tank cover 20 (right side in FIG. 7), and as shown on right side in FIG. 7, the total stress of the combined axial stress and bending stress acts upon the bottom end part 23.

Since such stress act on the bottom end part 23 of the tank cover 20, it is very important for the ship to maintain the fatigue strength of the bottom end part 23 of the tank cover 20.

On the other hand, in Japanese Unexamined Patent Application, First Publication No. Hei 1-164696, a technique is disclosed where a large opening is formed in a transverse bulkhead 12 of the hull 10 which separates spaces accommodating the adjacent independent spherical tanks 15 so as to make this transverse bulkhead 12 a flexible structure, whereby the stress acting on the bottom end part 23 of the tank cover 20 is alleviated.

In this technique disclosed in Japanese Unexamined Patent Application, First Publication No. Hei 1-164696, of the front and back ends and the left and right ends of the bottom end part 23 of the tank cover 20 on which particularly large loads act, the stress acting on the front and back ends can be sufficiently alleviated since the front and back ends are arranged just above the transverse bulkhead 12, being a flexible structure.

However, the stress acting on the left and right ends of the bottom end part 23 can not be sufficiently alleviated, since the left and right ends are arranged just above the side plating 13, being a rigid structure. Therefore, in the technique disclosed in Japanese Unexamined Patent Application, First Publication No. Hei 1-164696, it has been difficult to satisfy a high standard for fatigue strength, which has been recently required.

BRIEF SUMMARY OF THE INVENTION

The present invention takes the above problems into consideration with an object of providing a tank cover which can sufficiently ensure the fatigue strength of the bottom end part jointed to the upper deck of the hull, to improve the fatigue life, and a ship comprising such a tank cover.

In order to solve the abovementioned problems and achieve such an object, the tank cover according to the present invention is a tank cover which covers a protruding part of an independent spherical tank loaded in a ship, with one part protruding above an upper deck of a hull, and a bottom end part, to be jointed to the upper deck, is provided with a reinforced part which is reinforced for strength. In a ship according to the present invention, an independent spherical tank loaded with one part protruding above an upper deck of a hull has the part protruding above the upper deck covered by the tank cover of the present invention.

According to the present invention, since the reinforced part is provided for the bottom end part of the tank cover, where large loads occur due to the compression and tension, the stress acting on this bottom end part can be sufficiently alleviated and the fatigue strength of the bottom end part of the tank cover can be improved. Particularly, if the reinforced part is a thickened part in the bottom end part with a thickness greater than a thickness of other parts, then regardless of the simple construction, it becomes possible to sufficiently alleviate the stress acting on the bottom end part.

Moreover, if the reinforced part is provided on both ends in a direction along the width direction of the hull, it becomes possible to alleviate the stress acting on a severe part in view of fatigue strength, so that the fatigue strength of the bottom end part of the tank cover can be effectively improved.

Here, in the case where the reinforced part is the thickened part, a centerline in the thickness direction in the thickened part may be deviated to the inside of the tank cover from the centerline in the thickness direction in the other part.

In such a construction, an additional bending moment in the opposite direction to the normal bending moment when the bottom end part of the tank cover is bent to the inside of the tank cover is generated. Therefore, by the bending stress due to this additional bending moment, the bending stress due to the normal bending moment acting on the bottom end part can be cancelled, so that the fatigue strength of the bottom end part of the tank cover can be further improved.

DETAILED DESCRIPTION OF THE INVENTION

Hereunder is a description of a first embodiment of the present invention, with reference to the appended drawings. The same reference symbols are used for parts the same as those in the abovementioned prior art, and description thereof is omitted.

Figure 1:
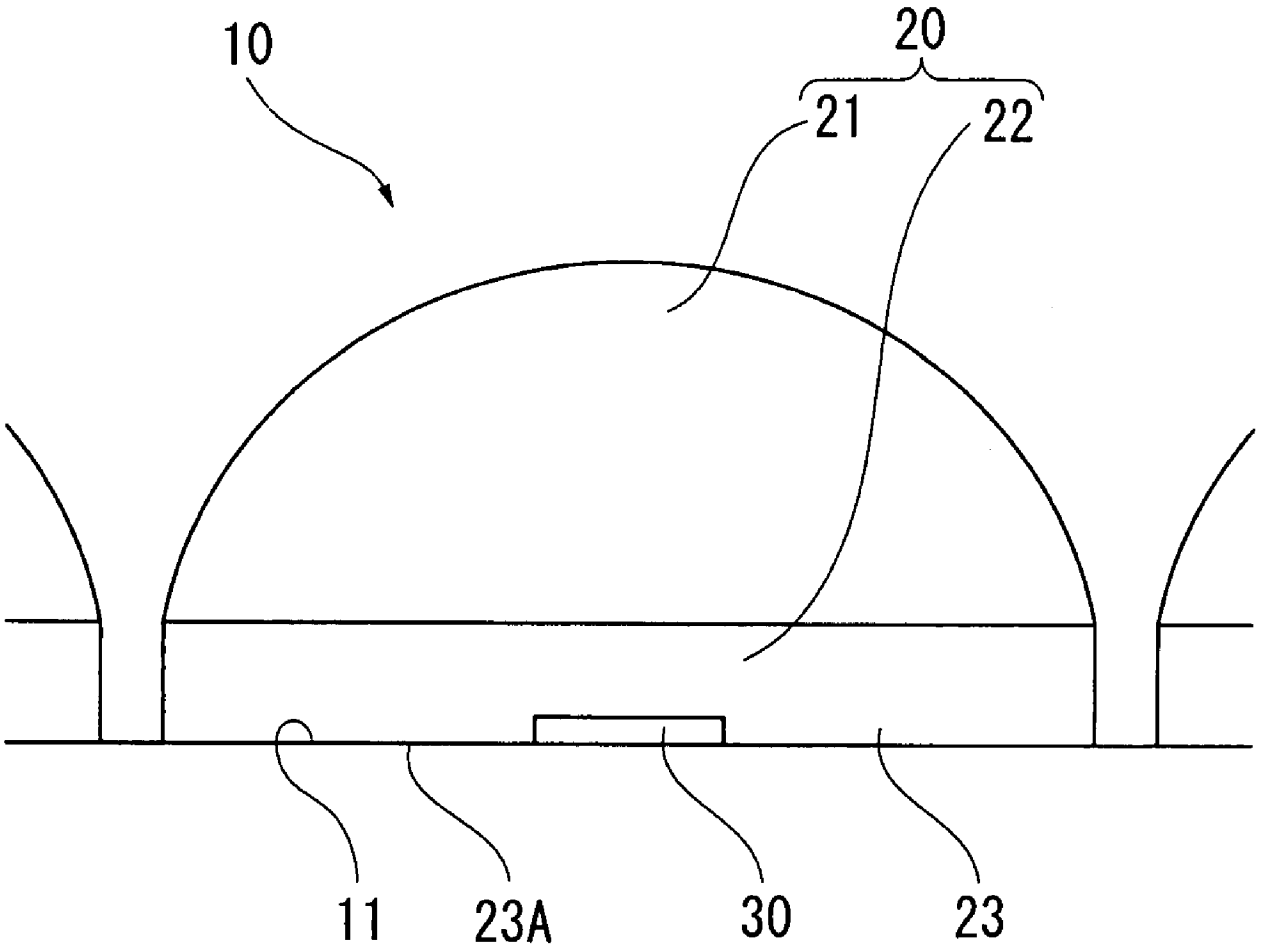
FIG. 1 is a side view showing a tank cover according to a first embodiment of the present invention.

A tank cover 20 according to the first embodiment of the present invention, as shown in FIG. 1, is a hollow body comprising an approximate hemispherical part 21 located on the upper side, and an approximate cylindrical part 22 located on the lower side. An edge part 23A in a bottom end part 23 of the approximate cylindrical part 22 (bottom end part 23 of the tank cover 20), is jointed to an upper deck 11 of a hull 10 by welding.

Moreover, on the left and right ends of the tank cover centerline, on the bottom end part 23 of the approximate cylindrical part 22 constituting the tank cover 20, that is, on both ends in the direction along the width direction of the hull 10 on the bottom end part 23, thickened parts 30 serving as reinforced parts which are reinforced for strength, are respectively provided.

Figure 2A:
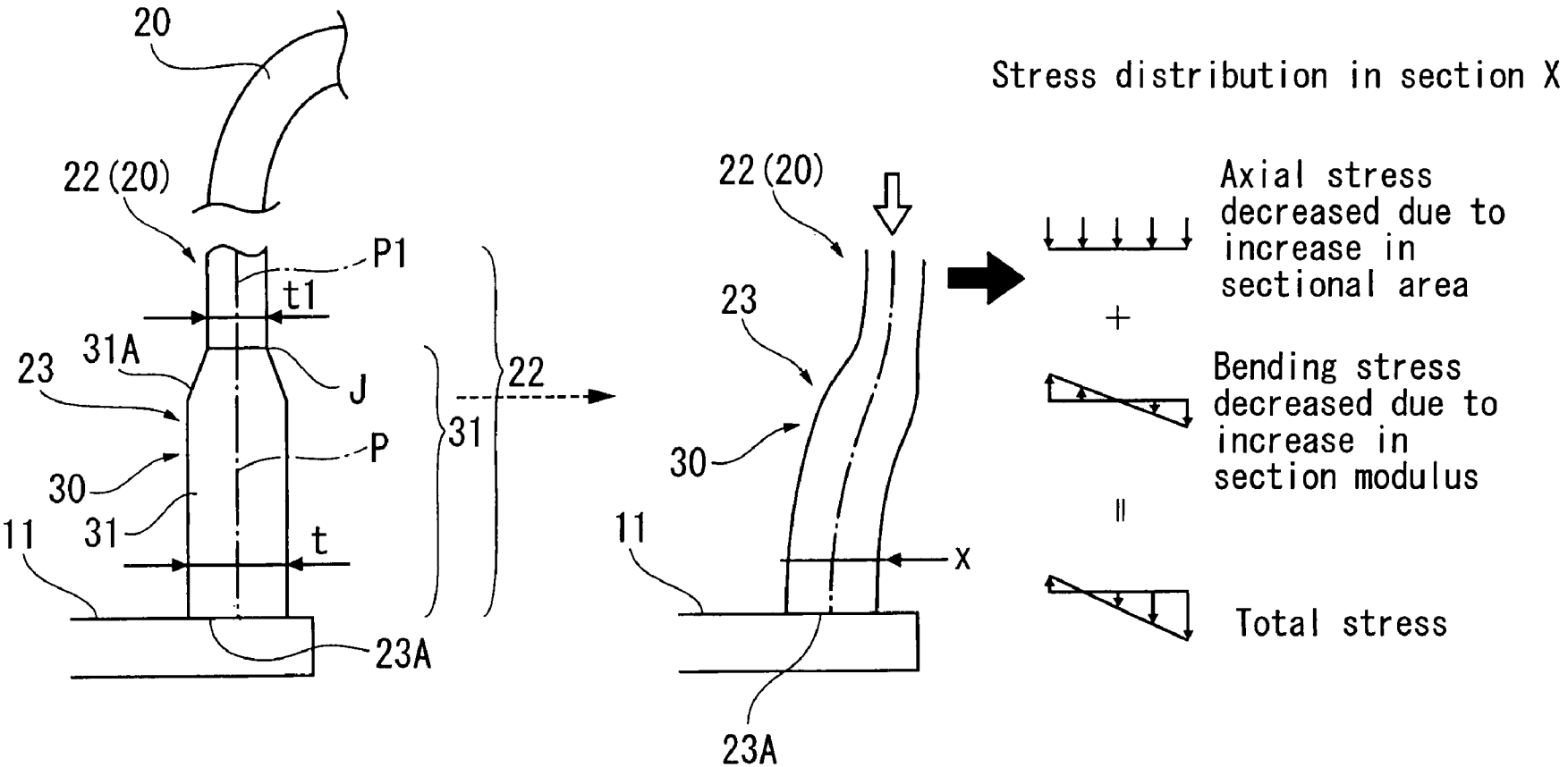
FIG. 2A is a sectional view showing the main parts of the tank cover according to the first embodiment of the present invention.
Figure 2B:
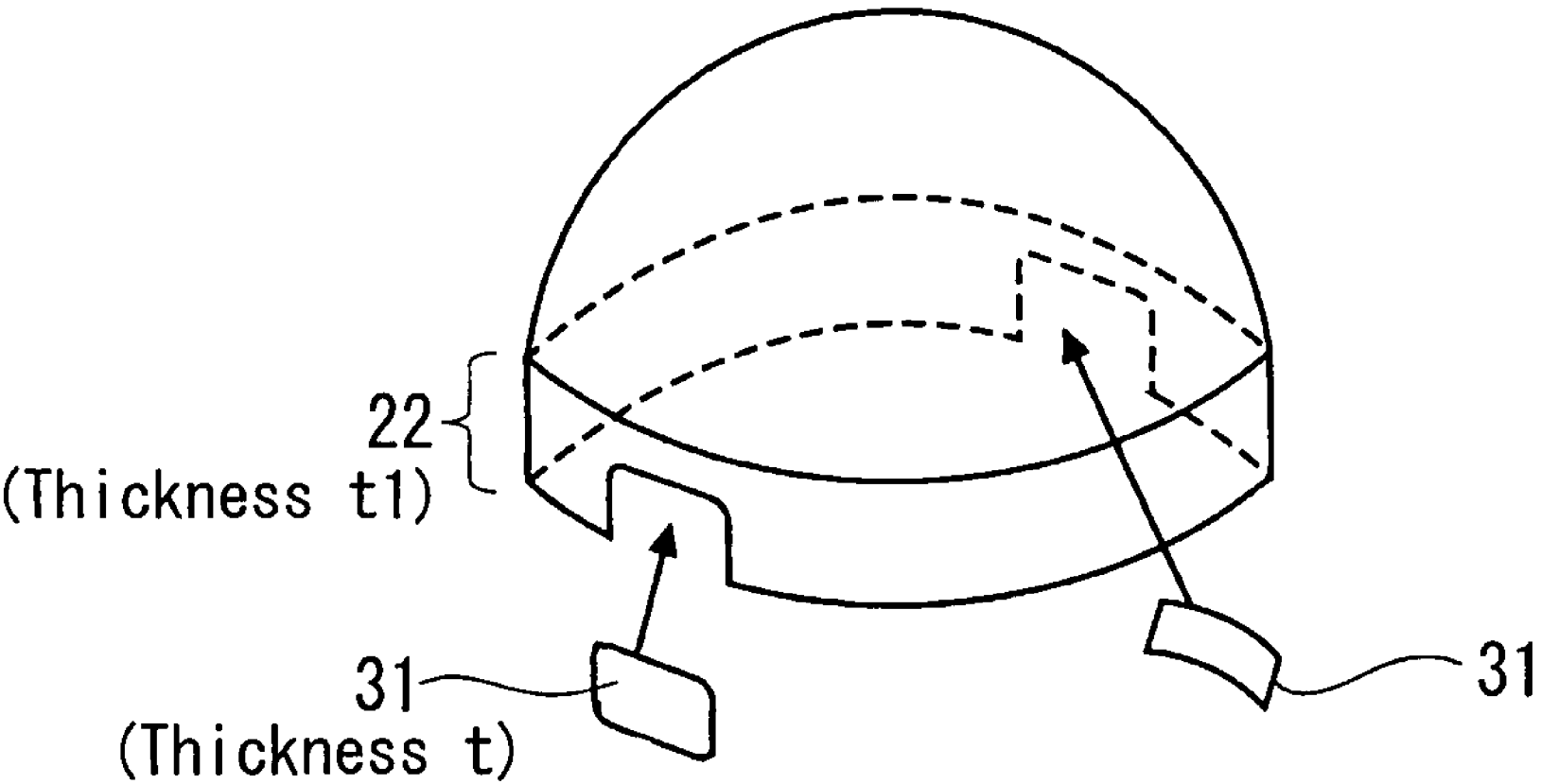
FIG. 2B is a perspective view showing a state where a plate is inserted and welded to the tank cover.

As shown in FIGS. 2A and 2B, the thickened parts 30 are a part of the bottom end part 23 of the tank cover 20 (including the edge part 23A) having its thickness locally increased. These have a thickness t (for example, t=50 mm) which is greater than the thickness t1 (for example, t1=20 mm) of the other parts than these thickened parts 30 (the approximate cylindrical part 22). For example, the size of the thickened parts 30, in the case of a tank cover having a 20 m diameter spherical shape, is about 5 m wide around the circumferential direction and about 500 mm in height.

To describe in detail, with respect to the approximate cylindrical part having the approximately constant thickness t1 around the whole perimeter in the circumferential direction and along the whole length in the height direction, the thickened part 30 is constructed with a joint J provided at the bottom end part 23, and a plate 31 of a predetermined thickness inserted and welded under the joint J (refer to FIG. 2B). This plate 31 is welded from the inside and outside of the tank cover 20 around the whole periphery.

Moreover, when the thickened part 30 is viewed in a cross section along the thickness direction, then as shown in FIG. 2A, a centerline P in the thickness direction of the thickened part 30, and a centerline P1 in the thickness direction of the other part than the thickened part 30 (the approximate cylindrical part 22 which continues upward from the thickened part 30) are located approximately on the same straight line.

The plate 31 inserted into the bottom end part 23 in order to constitute the thickened part 30 has an upper end part with a sloping face 31A sloping at an incline. The thickness of the part connecting the thickened part 30 and the approximate cylindrical part 22 which continues upward from the thickened part 30 is gradually reduced from the thickness t of the thickened part 30 to the thickness t1 of the other part at an approximately constant rate.

In the tank cover 20 according to the first embodiment having such construction, due to the vertical bending moment generated in the hull 10, if a load compressing toward the upper deck 11 (hollow arrow in FIG. 2A) and a deformation by a compressive force (thick solid arrow in FIG. 2A) toward the inside (right side in FIG. 2A) occur with respect to the left and right ends on the bottom end part 23 of this tank cover 20, then as shown in the central part in FIG. 2A, the thickened part 30 provided on the left and right ends of the tank cover centerline on the bottom end part 23 of tank cover 20 deforms so as to bend toward the inside of the tank cover 20 (right side in FIG. 2A).

Here, in the first embodiment, as shown in the right side portion in FIG. 2A, the axial stress and the bending stress act on the thickened part 30. However the axial stress acting on the thickened part 30 is decreased by increasing the sectional area of the thickened part 30 and the bending stress acting on the thickened part 30 is also decreased by increasing the section modulus of the thickened part 30.

Therefore, the total stress for the combination of the axial stress and the bending stress is greatly reduced compared to the case where the thickened part 30 is not provided. Accordingly, it becomes possible to sufficiently alleviate the stress acting on a severe part in view of fatigue strength, that is the left and right ends on the bottom end part 23 of the tank cover 20.

Consequently, the fatigue strength of the bottom end part 23 of the tank cover 20 can be effectively improved, resulting in a remarkable improvement in the fatigue life of the tank cover 20.

Figure 3:
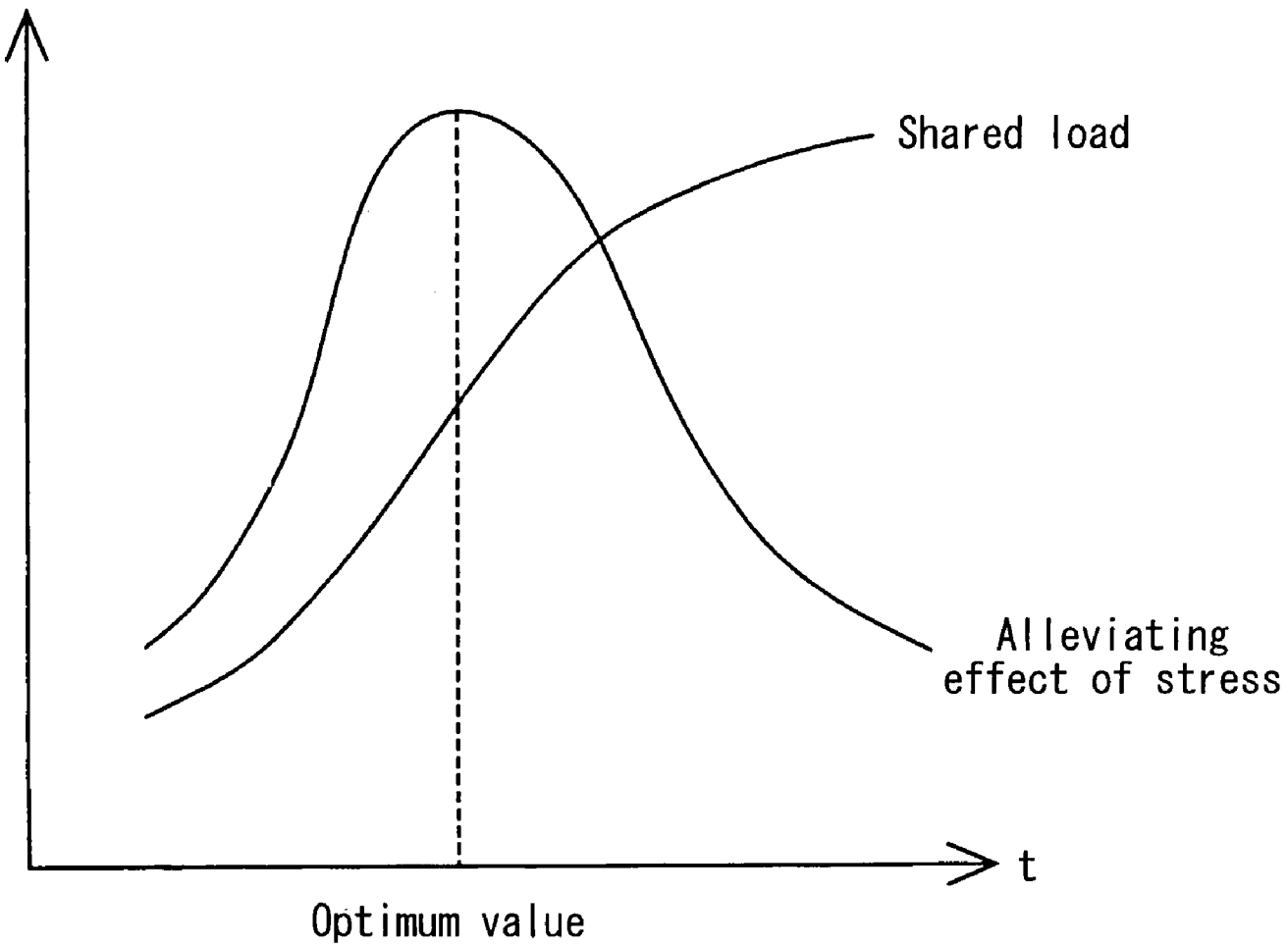
FIG. 3 is a graph related to the thickness of a thickened part.

Here, the abovementioned thickness t of the thickened part 30 is considered. As shown in a graph in FIG. 3, under the condition where the forced deformation amount added to the bottom end part 23 of the tank cover 20 is constant, as the thickness t of the thickened part 30 increases, its rigidity is also increased. Therefore the shared load acting on the thickened part 30 is also increased. If this shared load becomes too large, although this stress is slightly decreased since the value obtained by dividing the shared load by the thickness t of the thickened part 30 is the stress acting on the thickened part 30, the overall balance of the stress acting on the bottom end part 23 of the tank cover 20 is greatly disturbed, causing concern that the alleviating effect on the stress due to this thickened part 30 is lessened.

Therefore, regarding the thickness t of the thickened part 30, it is preferable to find and appropriately set an optimum value such that the alleviating effect on the stress due to this thickened part 30 becomes a maximum without causing such an undesirable situation.

Moreover, for the same reason as above, if the height of the thickened part 30 is increased too much (for example, the height of the thickened part 30 is extended to the knuckle part which is the ridgeline part at the intersection of the approximate cylindrical part 22 and the approximate hemispherical part 21), or if the length in the circumferential direction of the thickened part 30 (the circumferential direction of the approximate cylindrical part 22) is increased too much, there is concern that the alleviating effect of the stress due to this thickened part 30 is lessened. Therefore, regarding the height, and the length in the circumferential direction, it is preferable to find and appropriately set optimum values such that the alleviating effect of the stress due to this thickened part 30 becomes a maximum.

Next is a description of a second embodiment of the present invention, with reference to the appended drawings. The same reference symbols are used for parts equivalent to those in the abovementioned first embodiment, and description thereof is omitted.

Figure 4:
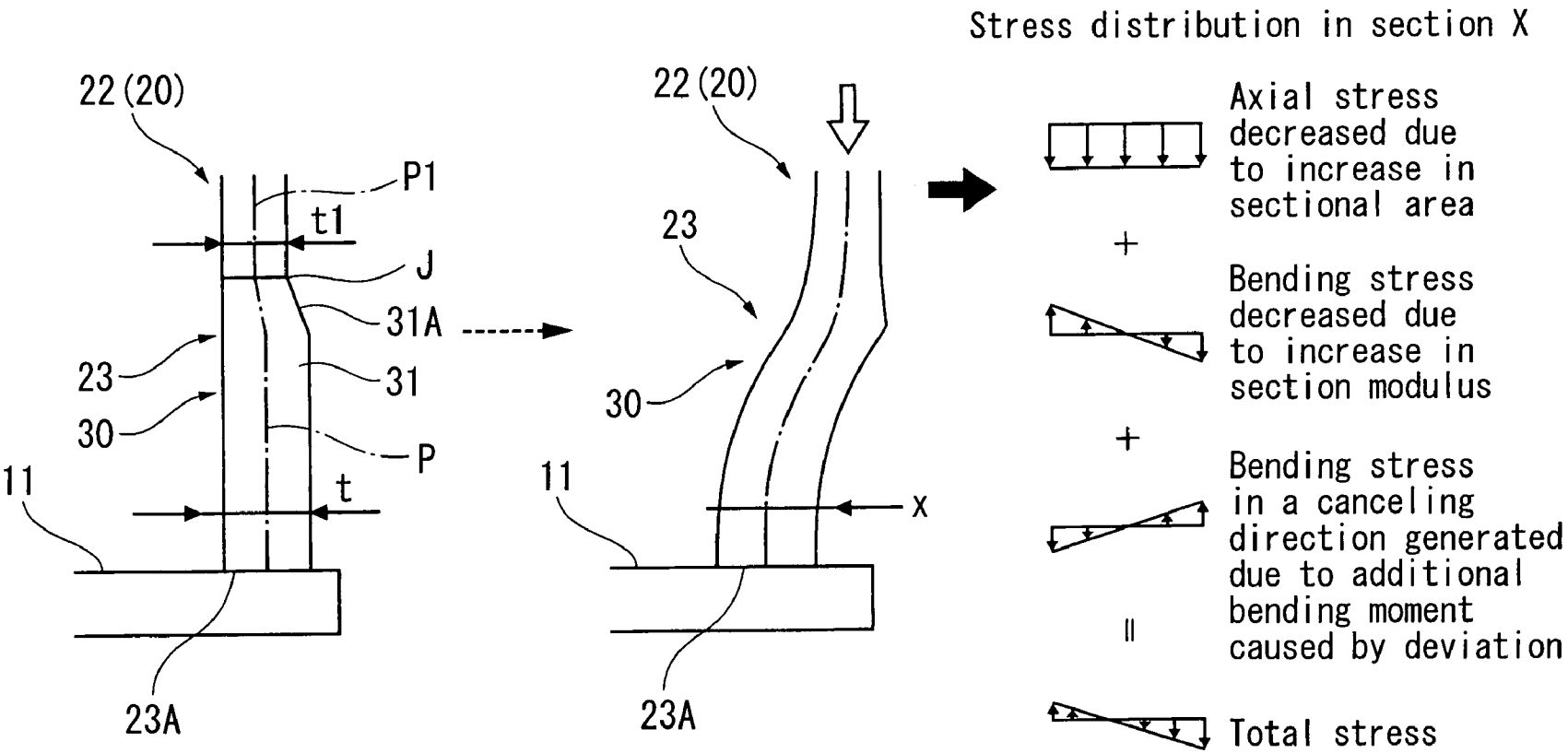
FIG. 4 is a sectional view showing the main parts of a tank cover according to a second embodiment of the present invention.
Figure 5:
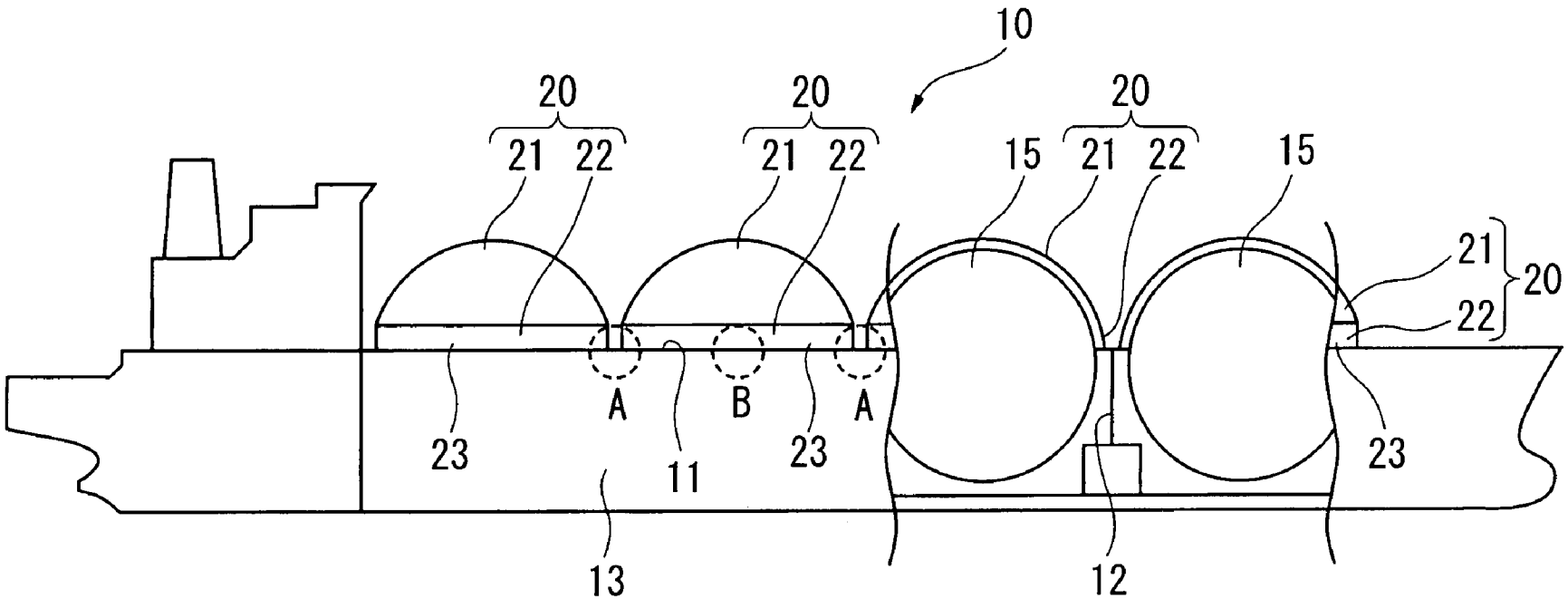
FIG. 5 is a side view showing an overall construction of a ship.
Figure 6A:
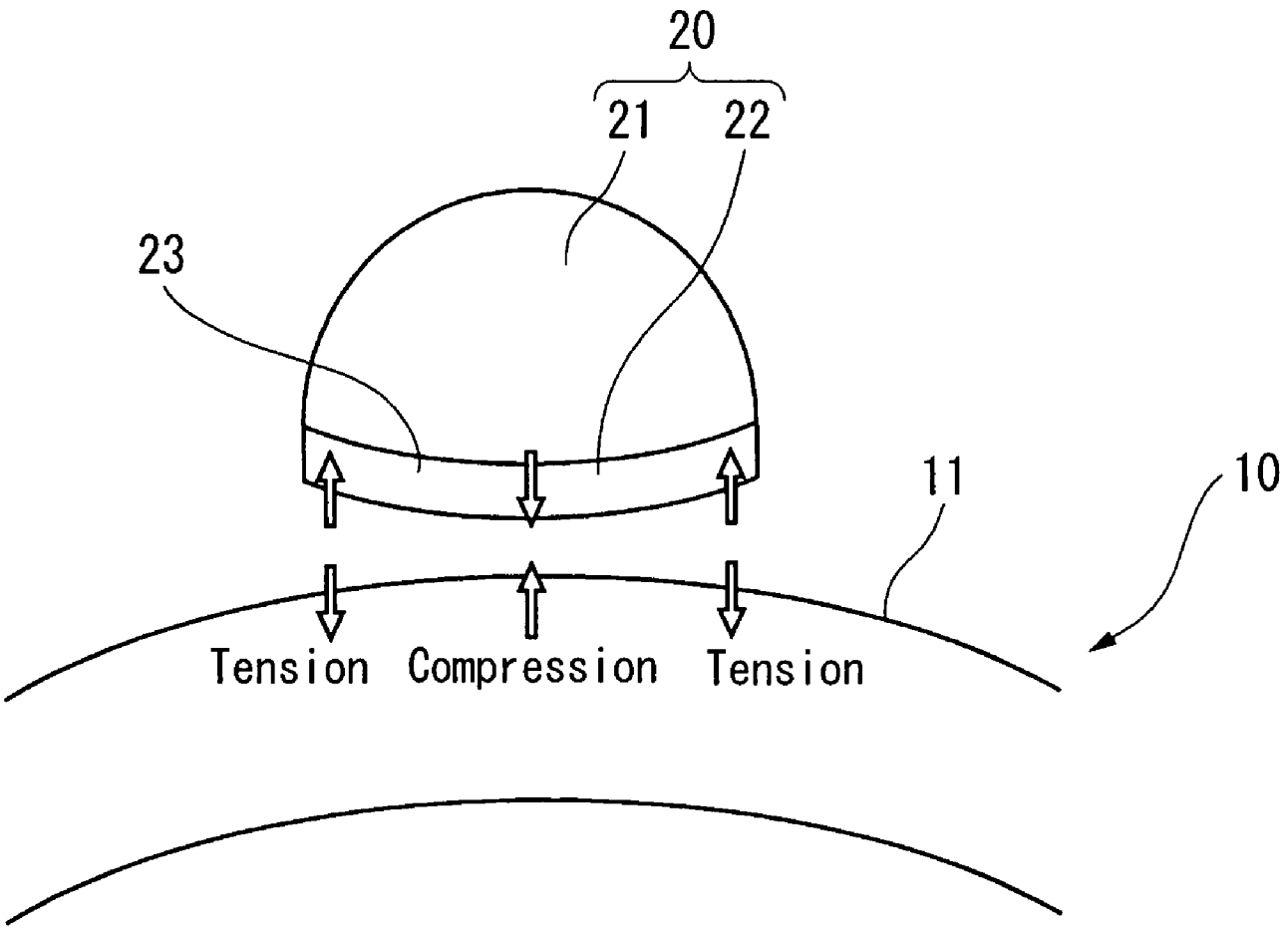
FIG. 6A is a side view showing a state when a vertical bending moment occurs in a hull to deform the hull.
Figure 6B:
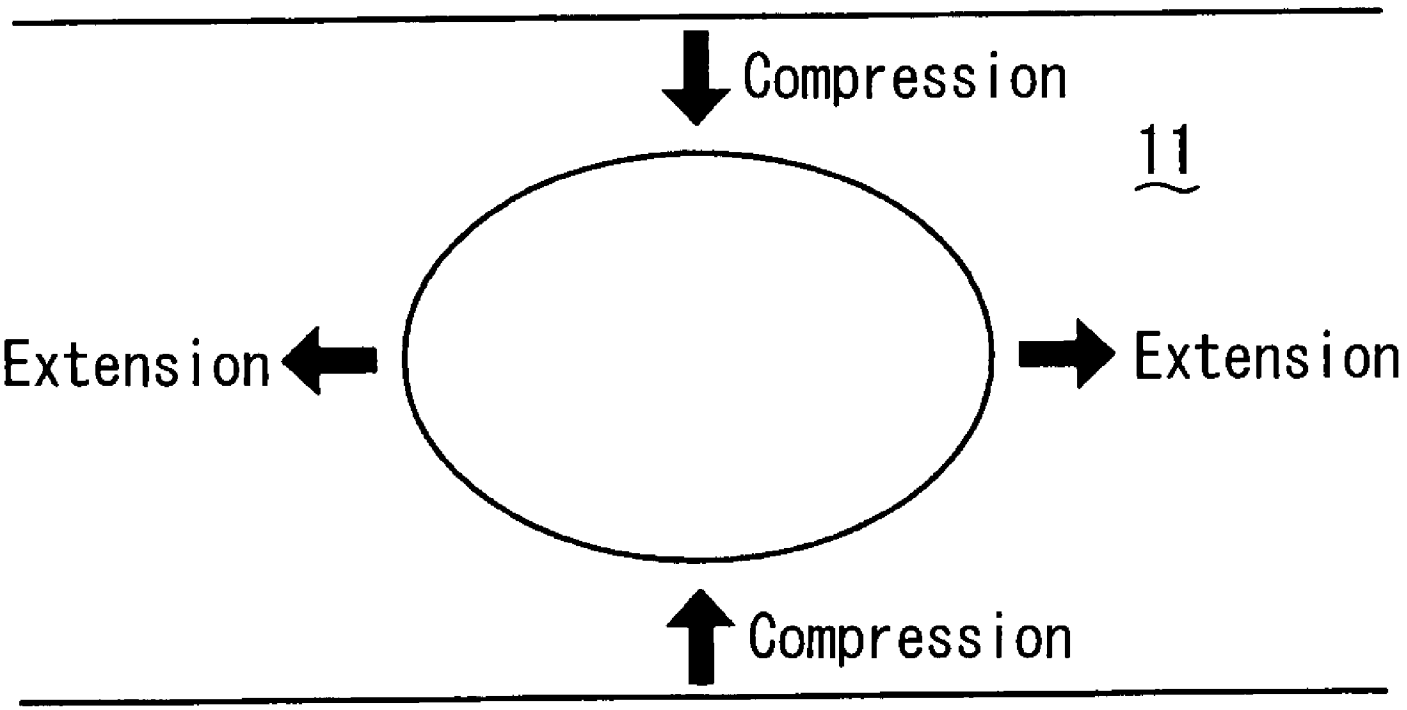
FIG. 6B is a plan view showing the state when a vertical bending moment occurs in a hull to deform the hull.
Figure 7:
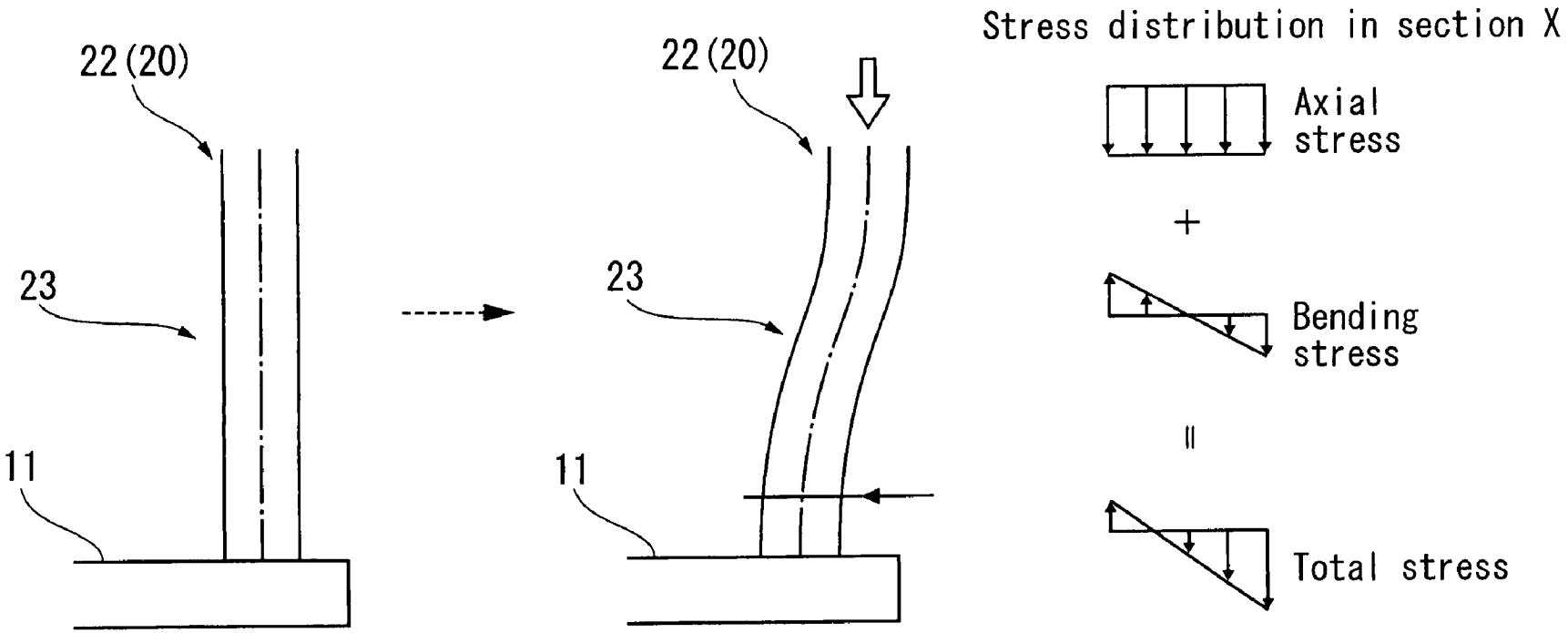
FIG. 7 is a sectional view showing the main parts of a conventional tank cover.

In the tank cover 20 according to the second embodiment, as shown in FIG. 4, the thickened part 30 is constituted by a plate 31 of a predetermined thickness inserted so as to increase the plate thickness only to the inside on the left and right ends of the bottom end part 23 (right side in FIG. 4) with respect to the approximate cylindrical part having an approximately constant thickness t1 over the whole perimeter in the circumferential direction and along the whole length in the height direction.

Moreover, when the thickened part 30 is viewed in a cross section along the thickness direction, then as shown in FIG. 4, the centerline P in the thickness direction of the thickened part 30, and the centerline P1 in the thickness direction of the other parts than the thickened part 30 (the approximate cylindrical part 22 which continues upward from the thickened part 30) are not located approximately on the same straight line. Instead, the centerline P in the thickness direction of the thickened part 30 is deviated to the inside of the tank cover 20 (right side in FIG. 4) from the centerline P1 in the thickness direction of the other part.

In the tank cover 20 according to the second embodiment having such a construction, due to the vertical bending moment generated in the hull 10, if a load compressing toward the upper deck 11 (hollow arrow in FIG. 4) and a deformation by a compressive force (thick solid arrow in FIG. 4) toward the inside (right side in FIG. 4) occur with respect to the left and right ends on the bottom end part 23 of this tank cover 20, then as shown in the central part in FIG. 4, the thickened part 30 provided on the left and right ends of the tank cover centerline on the bottom end part 23 of tank cover 20 deforms so as to bend toward the inside of the tank cover 20 (right side in FIG. 4).

Here, in the second embodiment, since the centerline P of the thickened part 30 is deviated to the inside of the tank cover 20 as described above, an additional bending moment is generated in the opposite direction to the normal bending moment for when the thickened part 30 is bent to the inside of the tank cover 20. Therefore, as shown on right side in FIG. 4, not only the axial stress and the bending stress similar to the first embodiment, but also a bending stress in a canceling direction due to the abovementioned additional bending moment act on the thickened part 30.

Therefore, the total stress for the combination of the axial stress, the bending stress, and the bending stress in a canceling direction is greatly decreased compared to the case where the thickened part 30 is not provided. In addition, it becomes possible to reduce particularly the stress acting upon the inside of the thickened part 30 where the axial stress and the bending stress are superimposed by the bending stress in a canceling direction. Consequently, the fatigue strength of the bottom end part 23 of the tank cover 20 can be further improved.

In the abovementioned respective embodiments, the thickened part 30 is provided only on the left and right ends of the tank cover centerline on the bottom end part 23 of the tank cover 20. However, it may be provided on the other parts as required. For example, in the case where the transverse bulkhead 12 of the hull 10 is not a flexible structure, then similarly to the left and right ends in the bottom end part 23 of the tank cover 20, the thickened part 30 may be provided on the front and back ends of the tank cover centerline on the bottom end part 23, which is the severest part in view of fatigue strength.

Moreover, in the abovementioned respective embodiments, the reinforced part provided on the bottom end part 23 of the tank cover 20 is the thickened part 30. However it is not limited to this, and for example it may also be considered to provide a stiffener (rib) as the reinforced part, for the bottom end part 23 of the tank cover 20.

Furthermore, the tank cover 20 of the abovementioned respective embodiments may be for covering an independent spherical tank loaded not only on an LNG carrier but also on a ship such as a DME (dimethyl ether) carrier. In short, the present invention may be effectively used as long as the ship is loaded with independent spherical tanks.

What is claimed is:

1. A tank cover for covering a protruding part of an independent spherical tank loaded in a ship having one part protruding above an upper deck of a hull, said tank cover comprising a bottom end part configured to be jointed to the upper deck that includes a reinforced part that has a thickness, greater than a thickness of another part of said bottom end part, said another part extending along a circumferential direction of said bottom end part, said reinforced part being provided on both ends of a centerline of said tank cover that is configured to extend in a direction along a width of the hull when said tank cover is positioned on the upper deck, wherein an upwardly extending centerline of said reinforced part is deviated toward an inside of said tank cover relative to an upwardly extending centerline of said another part.

2. A ship having an independent spherical tank loaded in the ship with one part protruding above an upper deck of a hull of the ship wherein said part protruding above the upper deck is covered by said tank cover of claim 1.

3. The tank cover of claim 1, wherein said reinforced part is a plate of a predetermined thickness welded into a space in said bottom end part.

4. The tank cover of claim 3, wherein said reinforced part includes an upper end part which tapers to a thickness of said another part.

5. The tank cover of claim 1, wherein said reinforced part comprises two reinforced parts positioned about said bottom end part so as to be diametrically opposed to each other.

6. The tank cover of claim 1, wherein a first end of said another part extends directly from a first end of said reinforced part.

7. A tank cover for covering a protruding part of an independent spherical tank loaded in a ship having one part protruding above an upper deck of a hull, said tank cover comprising:

an approximate hemispherical part;

an approximate cylindrical part located on a lower side of said approximate hemispherical part, wherein an edge part of a bottom end part of said approximate cylindrical part is configured to be jointed to the upper deck of the hull; and a reinforced part on said bottom end part having a thickness, greater than a thickness of another part of said bottom end part that extends along a circumferential direction of said bottom end part, and said reinforced part having a greater circumferential extent than vertical extent, wherein said reinforced part is provided on both ends of a centerline of said tank cover that is configured to extend in a direction along a width of the hull when said tank cover is positioned on the upper deck, and wherein an upwardly extending centerline of said reinforced part is deviated toward an inside of said tank cover relative to an upwardly extending centerline of said another part.

8. A ship having an independent spherical tank loaded in the ship with one part protruding above an upper deck of a hull of the ship wherein the part protruding above the upper deck is covered by said tank cover of claim 7.

* * * * *